US006739544B2

(12) United States Patent
Yuuki et al.

(10) Patent No.: US 6,739,544 B2
(45) Date of Patent: May 25, 2004

(54) WINDING ROLL PRESSER DEVICE AND LONG MATERIAL WINDING METHOD

(75) Inventors: Kouichi Yuuki, Niihama (JP); Kiyoshi Mannen, Iwakuni (JP)

(73) Assignees: Sumitomo Heavy Industries, Ltd., Tokyo (JP); Nippon Paper Industries, Co., Ltd., Tokyo (JP)

( * ) Notice: Subject to any disclaimer, the term of this patent is extended or adjusted under 35 U.S.C. 154(b) by 0 days.

(21) Appl. No.: 10/106,827

(22) Filed: Mar. 27, 2002

(65) Prior Publication Data

US 2002/0145072 A1 Oct. 10, 2002

(30) Foreign Application Priority Data

Mar. 29, 2001 (JO) ..... 2001-096196

(51) Int. Cl.[7] ..... B65H 18/26

(52) U.S. Cl. ..... 242/541.6; 242/541.3; 242/542.3

(58) Field of Search ..... 242/541.1, 541.3, 242/541.5, 541.6, 542.3

(56) References Cited

U.S. PATENT DOCUMENTS

| | | | | |
|---|---|---|---|---|
| 3,471,097 A | * | 10/1969 | Phelps | 242/422.6 |
| 4,746,076 A | | 5/1988 | Tomma et al. | |
| 4,883,233 A | | 11/1989 | Saukkonen et al. | |
| 5,848,756 A | | 12/1998 | Sollinger et al. | |
| 5,895,007 A | * | 4/1999 | Moller et al. | 242/527.2 |
| 5,918,830 A | | 7/1999 | Veräjänkorva et al. | |
| 5,938,144 A | | 8/1999 | Kaipf et al. | |
| 6,196,492 B1 | | 3/2001 | Baumeister | |
| 6,311,922 B1 | | 11/2001 | Beisswanger et al. | |
| 6,382,550 B1 | | 5/2002 | Aalto | |
| 6,402,081 B1 | * | 6/2002 | Rautakorpi et al. | 242/534 |
| 6,402,082 B1 | | 6/2002 | Madrzak et al. | |
| 6,622,958 B1 | | 9/2003 | Luomi et al. | |

FOREIGN PATENT DOCUMENTS

| | | |
|---|---|---|
| DE | 400 328 B | 12/1995 |
| DE | 296 11 251 U1 | 10/1996 |
| DE | 197 27 012 A1 | 1/1999 |
| DE | 933 320 A2 | 8/1999 |
| DE | 198 52 257 A1 | 5/2000 |
| DE | 698 07 755 T2 | 4/2003 |
| DE | 600 01 213 T2 | 5/2003 |
| EP | 0 860 391 A1 | 8/1998 |
| JP | 06255735 A | 9/1994 |
| JP | 11-29247 A | 2/1999 |
| JP | 11-29250 A | 2/1999 |
| JP | 2000-246511 A | 9/2000 |
| JP | 2000-264505 A | 9/2000 |
| WO | WO 99/61360 | 12/1999 |

* cited by examiner

*Primary Examiner*—Kathy Matecki
*Assistant Examiner*—Sang Kim
(74) *Attorney, Agent, or Firm*—Arent Fox PLLC

(57) ABSTRACT

A winding roll presser device that presses a winding roll by the entire width thereof, the winding roll being formed by a reel spool and a long material wound therearound, said device includes a plurality of rotational rolls arranged in parallel with one another in the width direction, a belt tensely wound so as to cover the plurality of rotational rolls, a first drive unit for moving the belt from a stand-by position so as to bring the belt into contact with the winding roll, and a second drive unit for pressing the winding roll with a straight part of the belt.

11 Claims, 9 Drawing Sheets

FIG.6

| ITEM | NORMAL BELT | HEAVY DUTY BELT |
|---|---|---|
| BELT RUBBER MATERIAL | SBR (STYRENE-BUTADIENE RUBBER) | SBR+FIBER |
| TENSILE STRENGTH (MPa) | 20 | 16 |
| ELONGATION AFTER FRACTURE (%) | 600 | 360 |
| ABRASION RESISTANCE | 180 | 250 |
| RUBBER HARDNESS (ShA) | | |
| 20°C | 63 | 86 |
| 40°C | 62 | 86 |
| 60°C | 60 | 82 |
| 70°C | 58 | 78 |
| BELT SIZE | | |
| INNER DIAMETER (mm) | 2,740 | 2,740 |
| WIDTH (mm) | 300/150 | 300/150 |
| THICKNESS (mm) | 7 | 7 |
| WEIGHT (Kg) | 9.4/5 | 9.4/5 |
| BELT CORE | | |
| MATERIAL | POLYETHYLENE CODE | POLYETHYLENE CODE |
| NUMBER OF CORDS (PER 100 mm) | 30 | 60 |
| FRACTURE STRENGTH (N/mm) | 180 | 350 |
| ELONGATION AFTER FRACTURE (%) | 12.5 | 12.5 |

WINDING ROLL PRESSER DEVICE AND LONG MATERIAL WINDING METHOD

BACKGROUND OF THE INVENTION

1. Field of the Invention

The present invention relates to a winding roll presser device used in a long material winding process, and to a long material winding method.

2. Description of the Related Art

A long material such as a paper web produced by a paper machine is wound around a reel spool in a winding process. When the diameter of the winding roll reaches a predetermined final winding diameter, a new reel spool is moved from the stand-by position to the winding position. The long material is then cut, and the cut end of the long material is wound around the new reel spool. This procedure will be hereinafter referred to as "frame change". The last end of the long material that has just been cut off stays on the winding roll, and, then, is moved to the discharge position together with the winding roll. In the discharge position, the winding roll is sent to the next process.

Where the long material is cut at the time of frame change as described above, the winding roll rotates under its own inertia even after the rotation of the reel spool is stopped. As a result, the last cut end of the long material flaps, causing slackness equivalent to a few circles on the outer periphery of the winding roll. The slacked part of the winding roll cannot have sufficient tension, even when the winding roll is set to a rewinding device. With the slackness of the winding roll, a slitting operation cannot be performed. In a case where the long material is coated paper, the coating is damaged due to the rubbing, and the long material can no longer have a commercial value. To maintain the commercial value of the long material, the slacked part is cut off manually, and becomes a waste paper.

Various methods have been suggested to prevent the slackness of paper and reduce paper loss. For instance, Japanese Laid-Open Patent Application Nos. 2000-264511, 2000-264505, and 11-29250 disclose methods in which the winding roll is pressed by a press roll or a brush to prevent the flapping of the last cut end of the paper web. Japanese Laid-Open Patent Application No. 11-29247 discloses a method in which a groove is formed through the windup reference roll (a reel drum) of the winding roll, so that the air caught between the layers of the winding roll can be exhausted through the groove.

However, neither a roller nor a brush can give the winding roll a linear pressure (a pressure per unit length in the width direction) that is sufficient to prevent slackness of paper and reduce paper loss. If a great pressure were given by the roller or the brush, the pressure concentrates in a narrow area, and reduces the quality of the long material. In a worst case, the long material might be ripped due to the pressure.

There has been a method in which the diameter of a roll for pressing is increased so as to widen the contact area and disperse the linear pressure. In this method, however, the inertia of the press roll becomes larger, resulting in higher production costs and running costs. For instance, Japanese Patent Publication No. 6-94319 discloses a method in which an endless support web device is employed to support the winding roll over a wide area. In this method, however, the winding roll is supported by its own weight from below. To endure the weight of the winding roll, the support web device must be very large in size, and therefore requires a very large space.

SUMMARY OF THE INVENTION

Accordingly, it is a general object of the present invention to provide a novel and useful winding roll presser device used in a long material winding process and a long material winding method.

Another and more specific object of the present invention is to provide a winding roll presser device and a long material winding method that can reduce loss of paper.

The above objects of the present invention are achieved by A winding roll presser device that presses a winding roll by the entire width thereof, the winding roll being formed by a reel spool and a long material wound therearound, said device including a plurality of rotational rolls arranged in parallel with one another in the width direction, a belt tensely wound so as to cover the plurality of rotational rolls, a first drive unit for moving the belt from a stand-by position so as to bring the belt into contact with the winding roll, and a second drive unit for pressing the winding roll with a straight part of the belt.

The above objects of the present invention are also achieved by a method of winding a long material around a winding roll via a nip, in which the long material is transported on the reel drum and the nip is formed by the winding roll contacting the reel drum, said method comprising the steps of: a) rotating a winding roll presser device that presses the winding roll by the entire width thereof, at a speed equivalent to the rotational speed of the outer periphery of the winding roll; b) bringing the winding roll presser device from a stand-by position into contact with the outer periphery of the winding roll by a predetermined length in the transporting direction of the long material; c) increasing a linear pressure on the winding roll presser device to a predetermined level; d) cutting the long material before the reel drum; e) separating the winding roll from the reel drum after a linear pressure on the nip is reduced to zero; and f) stopping the rotation of the winding roll and the winding roll presser device.

With the above device and method in accordance with the present invention, the belt is brought into contact with the winding roll by a longer length in the transporting direction of the long material, because a wide and straight part of the belt contacts the winding roll. Accordingly, the linear pressure can be dispersed more effectively, compared with a case where a simple roll is brought into contact with a winding roll. As a result, the long material is not ripped or damaged despite the high linear pressure, and the high quality of the product is maintained. Thus, loss of paper can be reduced. Furthermore, since the belt is made of soft reinforced rubber, slackness of the winding roll can be prevented by the high linear pressure during the winding, while the high quality of the long material is maintained. Generally, paper loss of approximately 3000 m is caused, but, in accordance with the present invention, the paper loss can be reduced to 1000 m or less. The linear pressure is preferably in the range of 300 N/m through 3000 N/m in accordance with the present invention.

The above and other objects and features of the present invention will become more apparent from the following description taken in conjunction with the accompanying drawings.

BRIEF DESCRIPTION OF THE DRAWINGS

FIG. 6 is a table showing the comparison between materials used for belts in winding roll presser device;

DESCRIPTION OF THE PREFERRED EMBODIMENTS

Figure 1:
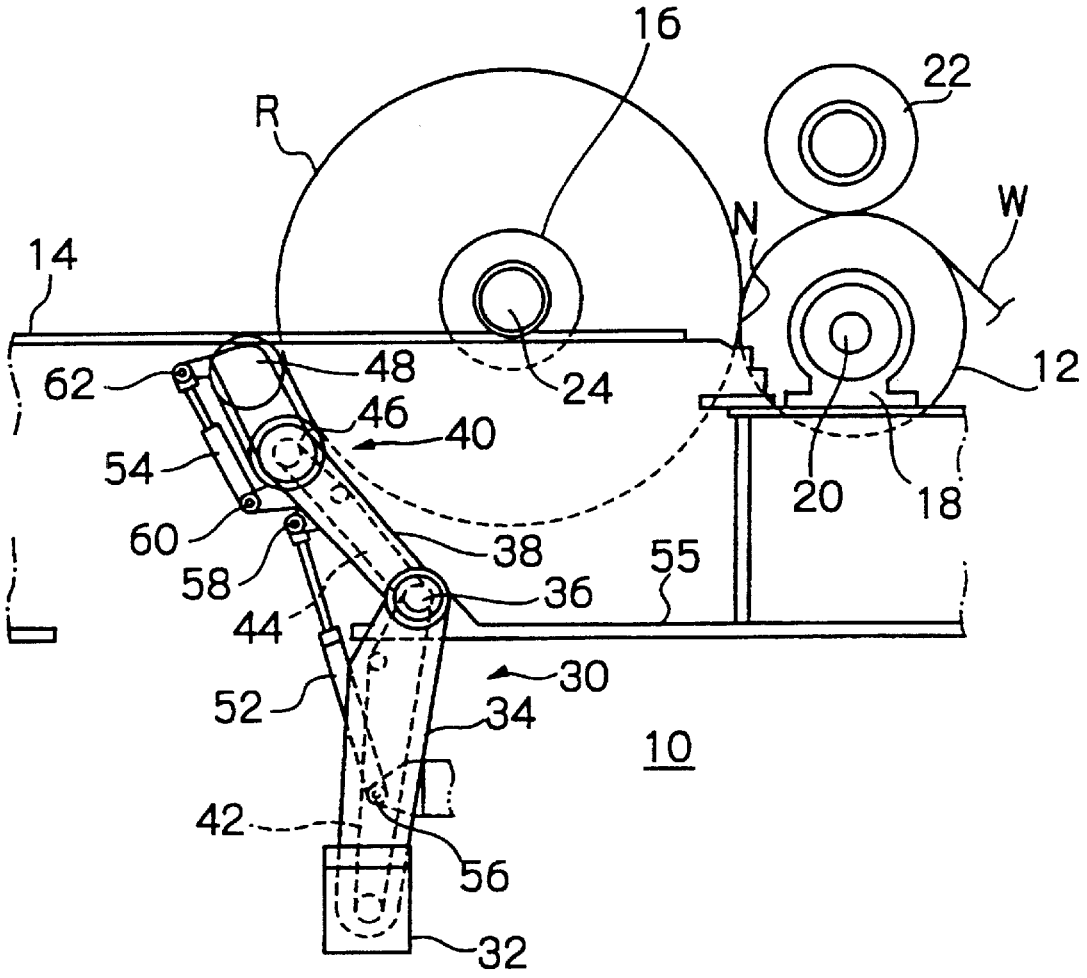
FIG. 1 is a view showing a winding roll presser device in a situation where a belt roll is in contact with a paper web in accordance with the present invention.

The following is a description of embodiments of the present invention, with reference to the accompanying drawings. In the drawings, like components are denoted by like reference numerals, and components that are not relevant to the present invention are omitted.

FIG. 1 is a view showing an embodiment of a winding roll presser device in accordance with the present invention. In this embodiment, a paper web W is used as a long material to be wound. However, the present invention can also be applied to other long materials such as plastic film or metallic film that can be wound into a roll. The present invention is particularly effective for a long material having a small friction coefficient. With a small friction coefficient, there will be a large amount of slippage, resulting in slackness of the long material.

A winder device 10 includes a reel drum 12, a frame changer that is not shown, rails 14, and a carriage that is not shown. The reel drum 12 is in contact with a winding roll R having a paper web W wound around a reel spool 16, and thus forms a nip N. The reel drum 12 rotates around a rotation axis 20 fixed by a base 18. In FIG. 1, the reel drum 12 rotates counterclockwise so as to transport the paper web W to the winding roll R.

The frame changer, which is not shown, may be a gooseneck-type frame changer disclosed in Japanese Laid-Open Patent Application No. 2000-264511. The gooseneck-type frame changer holds a plurality of reel spools 22 for winding the paper web W above the reel drum 12. In FIG. 1, only one of the reel spools 22 is shown for convenience. When frames are changed, a new reel spool 22 is brought into contact with the frame changing position at the top of the reel drum 12, as shown in FIG. 1. The new reel spool 22 then rotates clockwise with the rotation of the reel drum 12. The paper web W is cut off with a cutter (not shown) that is located in front of the reel drum 12. The top cut end of the paper web W is wound around the winding roll R, while the last cut end is glued to the new reel spool 22 at the same time as the cutting and then wound around the new reel spool 22. When the winding roll R separates from the reel drum 12 so as to form a sufficient space, the new reel spool 22 that has started winding the paper web W comes down to the normal winding position on the rails 14, and continues the winding.

Although a gooseneck-type frame changer is employed in this embodiment, a frame changing method is not limited to the method described above. For instance, the frame changing can be conducted with air blow from below, or with assistance of ribbon or tape.

The rails 14 support the winding roll R that is rotating, and horizontally extend from the reel drum 12. The shaft 24 of the winding roll R is supported by the rails 14.

The carriage, which is not shown in the figure, is located below the rails 14, and moves the winding roll R. The carriage acts on the shaft 24 of the winding roll R, and thus moves the winding roll R in the transverse direction. By virtue of this function of the carriage, the winding roll R can maintain the contact with the reel drum 12. The carriage also controls the linear pressure of the nip N formed by this contact (the linear pressure will be hereinafter referred to as the "nip pressure").

Figure 8:
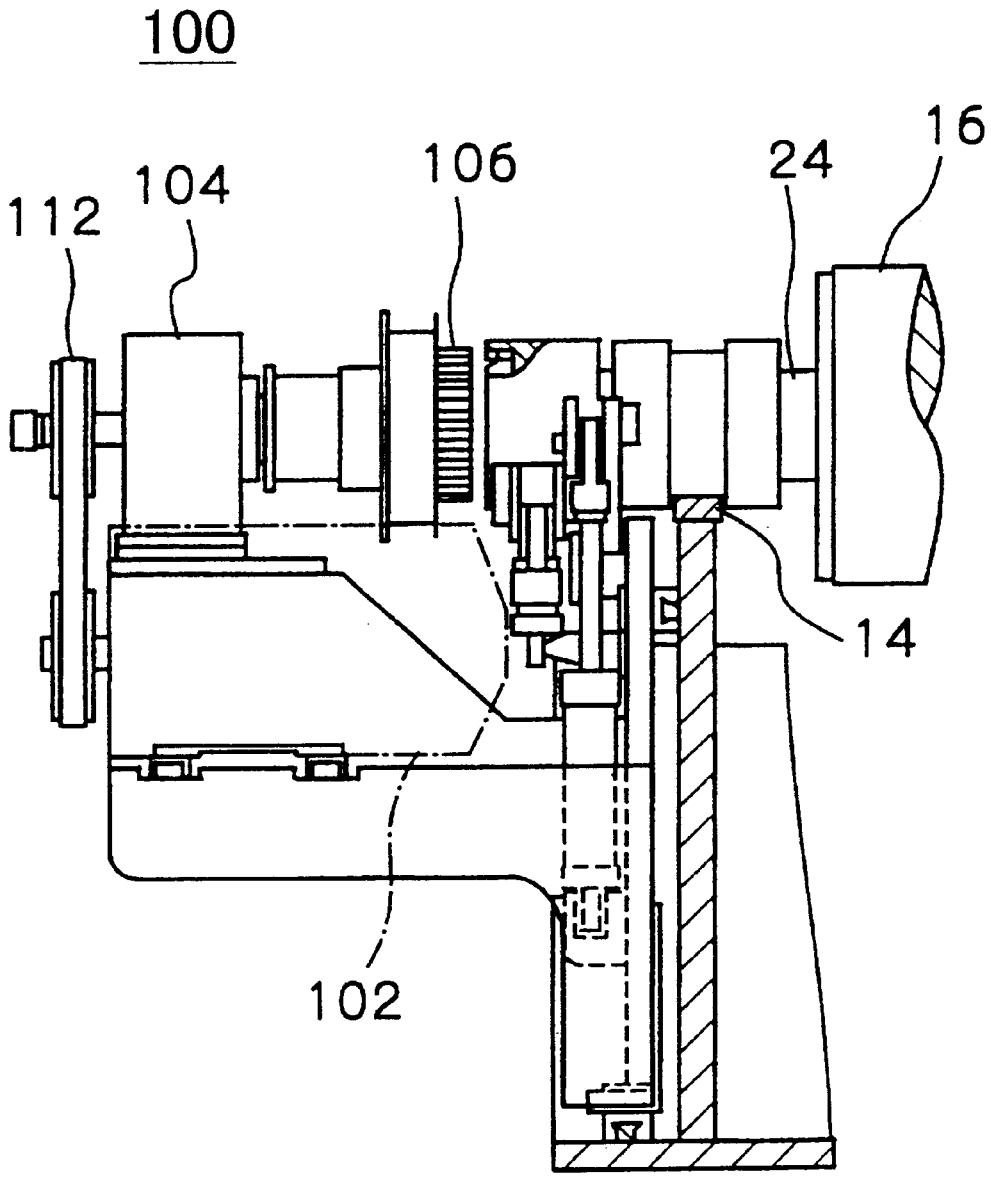
FIG. 8 is a view showing the structure of a center drive device that is used in conjunction with the winding roll presser device in accordance with the present invention.

FIG. 8 is a view showing the structure of a center drive device 100 that is mounted onto the carriage. It should be noted that the center drive device 100 is not shown in FIGS. 1 through 5 for convenience. The center drive device 100 includes a motor 102, a speed reducer 104, a coupling 106. The center drive device 100 gives turning force or braking force to the shaft 24 via the coupling 106 so as to rotate or stop the reel spool 16.

Figure 9:
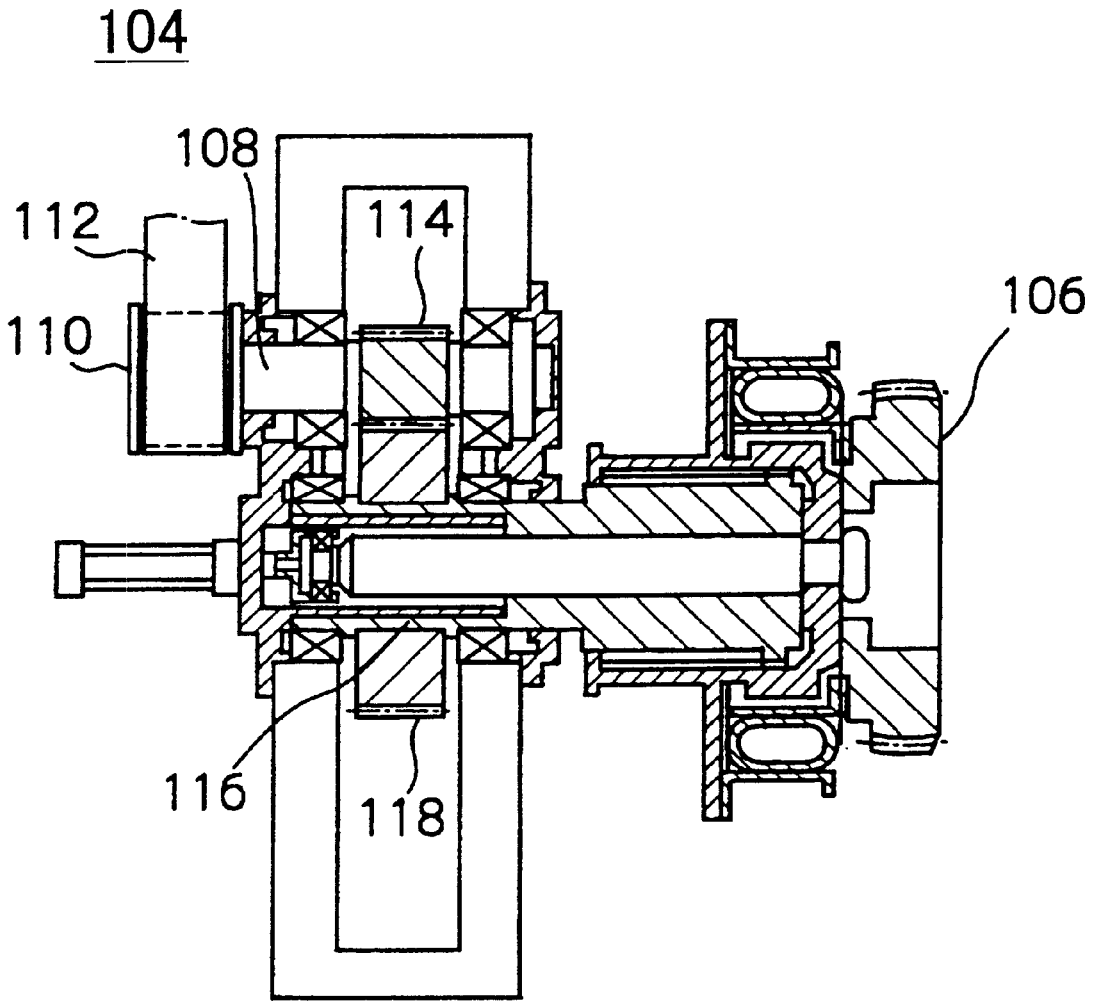
FIG. 9 is a sectional view of the center drive device in greater detail.

FIG. 9 is a sectional view of the center drive device in greater detail. An input axis 108 of the speed reducer 104 is provided with a pulley 110, so that the motive power of the motor 102 can be transmitted through a belt 112. Furthermore, a small gear 114 is fixed to an input axis 108. Meanwhile, a large gear 118 is fixed to a main axis 116 on the output side of the speed reducer 104. The large gear 118 meshes with the small gear 114, so as to reduce the speed.

Referring back to FIG. 1, the winding roll presser device 30 of the present inventions includes a motor 32, a fixed arm 34 connected and fixed to the motor 32, a movable arm 38 connected to the fixed arm 34 with a rotation axis 36, and a belt roll 40 attached to the top end of the movable arm 38. A timing belt 42 is driven by the motor 32 in a loop-like state through the fixed arm 34, and, at the rotation axis 36, transmits the motive power to another timing belt 44 moving through the movable arm 38. The timing belt 44 is also driven in a loop-like state, and, at the top end of the movable arm 38, transmits the motive power to a belt core 46. The belt roll 40 includes two belt cores 46 and 48 that are arranged in parallel with each other in the width direction, with a constant distance maintained between the belt cores 46 and 48. Press belts 50 are wound in an oval shape around the two belt cores 46 and 48. As the belt core 46 to which the motive power has been transmitted rotates, the press belts 50 rotate on the oval-shaped track.

The winding roll presser device 30 of the present invention further includes a first hydraulic cylinder 52 and a second hydraulic cylinder 54. The first hydraulic cylinder 52 is connected to a rotation axis 56, to which the base of the first hydraulic cylinder 52 is fixed. The top end of the first hydraulic cylinder 52 is connected to a rotation axis 58 that is fixed to the movable arm 38. Accordingly, as the first hydraulic cylinder 52 elongates and shortens, the movable arm 38 rotates around the rotation axis 36. As for a floorboard 55, the parts corresponding to the areas in which the movable arm 38 and other components operate are cut out from the floorboard 55, so as not to hinder the operation of the winding roll presser device 30.

The second hydraulic cylinder 54 is connected to a rotation axis 60 fixed to the movable arm 38, and to a rotation axis fixed to the top end of the belt roll 40. Accordingly, as the second hydraulic cylinder 54 elongates and shortens, the belt roll 40 rotates around the belt core 46 with respect to the movable arm 38. Instead of the hydraulic cylinders 52 and 54, pneumatic cylinders or other liquid-operated cylinders may be employed in the present invention.

The straight parts of the belt roll 40 are in contact with the winding roll R, and thus puts a linear pressure onto the winding roll R, so as to prevent the winding roll R from having slackness (the linear pressure will be hereinafter referred to as "contact pressure"). As described above, the belt roll 40 includes the two belt cores 46 and 48. In the present invention, a known belt roll for supporting a winding roll may be employed. For instance, Japanese Laid-Open Patent Application No. 10-218443 discloses such a belt roll for supporting a winding roll. In the above described related art, however, the belt roll is used simply for supporting a winding roll from below, while the winding roll is winding a material. In this aspect, the belt roll of the prior art is not used for pressing the cut ends of a long material and thus preventing slackness.

Figure 2:
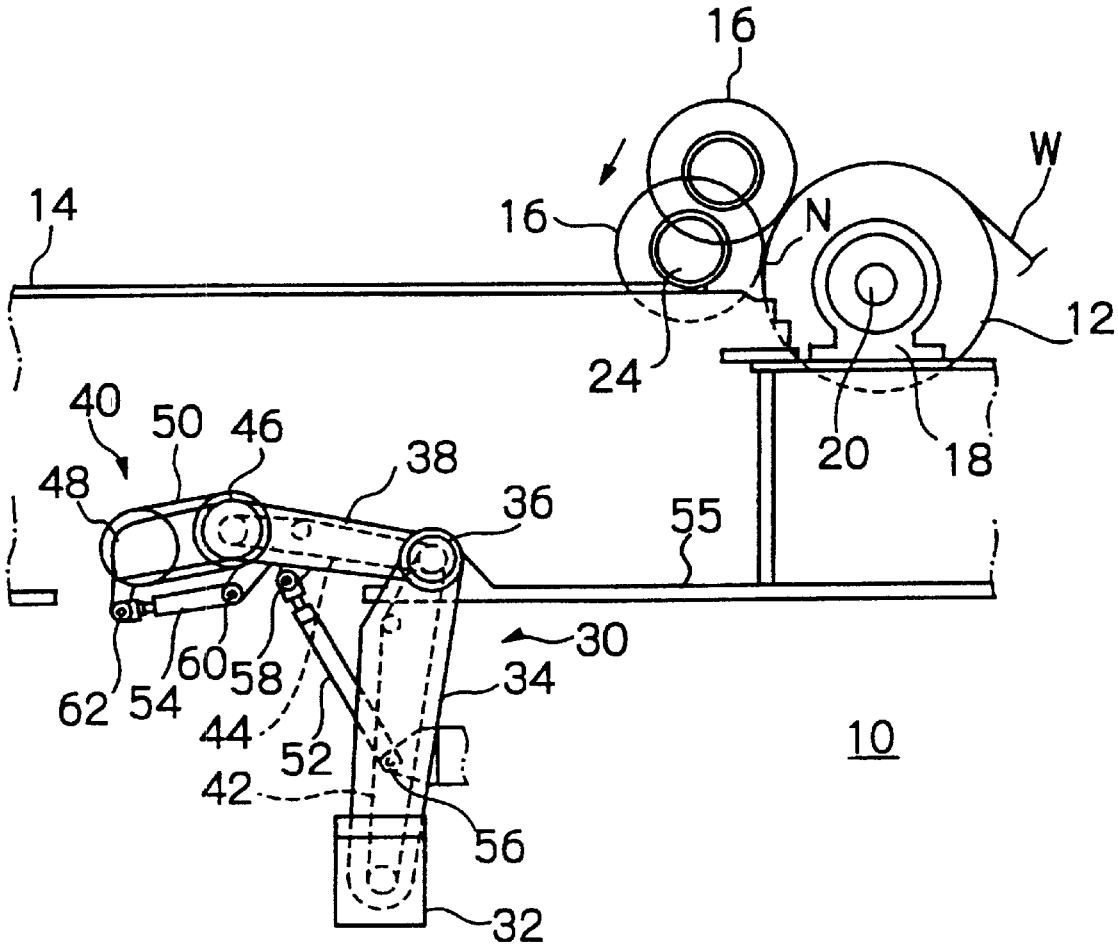
FIG. 2 is a view showing an initial state in a winding process of the winding roll presser device in accordance with the present invention.
Figure 5:
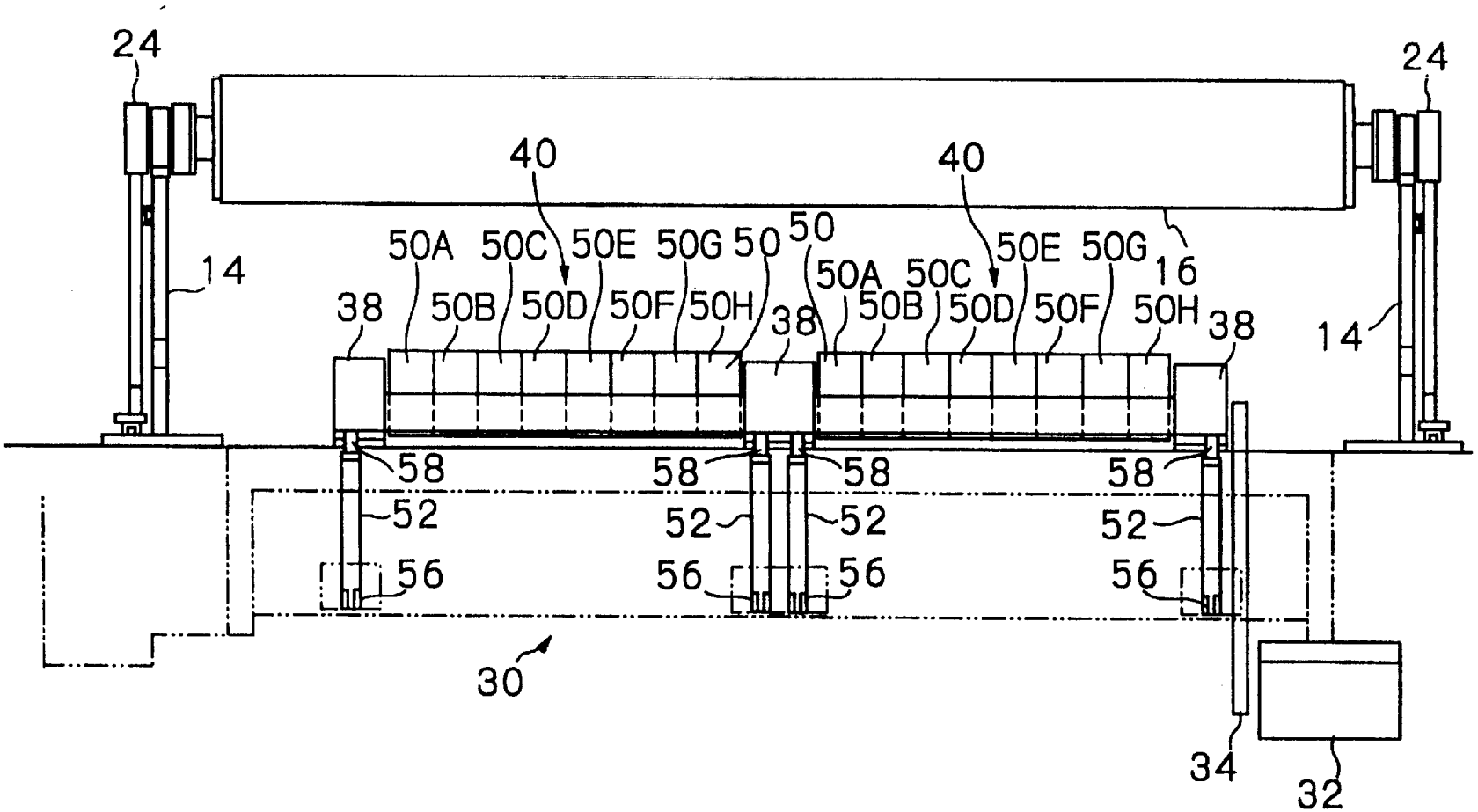
FIG. 5 is a side view of the winding roll presser device of FIG. 2, seen from the left side.

FIG. 2 is a view showing the winding roll presser device 30 and other components in the initial state of a winding process, and FIG. 5 is a side view of the winding roll presser device 30 and other components shown in FIG. 2. As shown in FIG. 5, the belt roll 40 extends in the width direction, and substantially covers the reel spool 16 by the entire width of the reeling part on which the paper web W is to be wound. Although the belt roll 40 is formed by two belt parts in this embodiment, it may consist of more than two belt parts or may be integrally formed.

In this embodiment, each belt part of the belt roll 40 has a belt 50 that is formed by eight partial belts 50A through 50H. The partial belts 50A through 50H are arranged in parallel with one another in the width direction. However, the partial belts 50A through 50H may be integrally formed. As shown in FIG. 5, four of the aforementioned hydraulic cylinder 52 for bringing the belt roll 40 into contact with the winding roll R are employed in this embodiment. Those hydraulic cylinders 52 operate synchronously so as to bring all the belt parts of the belt roll 40 into contact with the winding roll R at once.

The material used for the belts 50 wound around the belt cores 46 and 48 is styrene-butadiene rubber containing a reinforced fiber, for instance. In this embodiment, a heavy duty belt shown in a table of material properties in FIG. 6 is used. This is just an example, and a belt of any other material can be employed, as long as the effects of the present invention are obtained. As shown in FIG. 6, the heavy duty belt is harder than a normal belt. When the same tensile force is applied to both, the elongation of the heavy duty belt is smaller than that of a normal belt. Although belt sizes and belt core materials are also shown in FIG. 6, they are merely examples, and the present invention is not limited to these examples.

Figure 7:
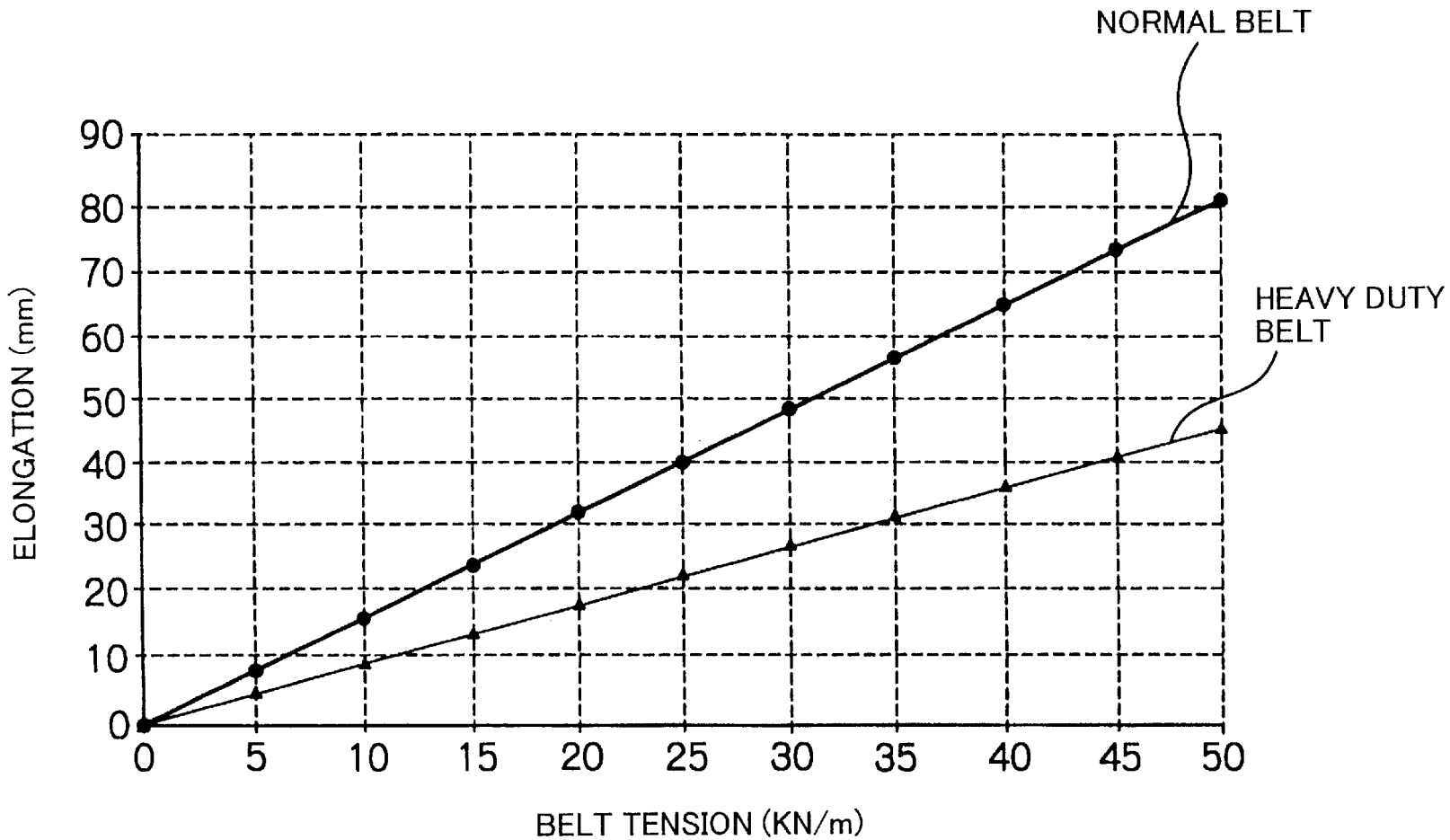
FIG. 7 is a graph showing the relationship between the belt tension and elongation.

FIG. 7 is a graph showing the relationship between belt tension and elongation. As can be seen from the graph, a normal belt and a heavy duty belt both have elongation that is proportional to the tensile force, but the elongation of the heavy duty belt is smaller than the elongation of the normal belt.

Each of the belts 50 is made of a reinforced rubber, but is much softer than a material that forms the belt cores 46 and 48, such as polyethylene cords or cast iron. Accordingly, even if the belt puts a great linear pressure (contact pressure) onto the winding roll R, the paper web will not be damaged or ripped. Each of the belts 50 runs on the oval-shaped track, and the straight parts of the belts 50 press the winding roll R. In this manner, the contact area between the winding roll R and the belts 50 in the winding direction of the paper web W is wider, compared with a case where a simple cylindrical roll presses the winding roll R. Accordingly, the contact pressure is dispersed in the winding direction of the paper web W. Thus, the paper web W can be protected from damage, despite the great linear pressure.

The belt roll 40 may include three or more belt cores that are arranged in parallel with one another in the width direction. In such a case, the belts 50 are tensely wound so as to cover all the belt cores, and one of the straight parts of the belts 50 presses the winding roll R. The belt roll 40 may further include a tension controller disclosed in Japanese Laid-Open Patent Application No. 10-218443. With such a tension controller, the contact pressure can be adjusted by controlling the belt tension.

The operation of the embodiment of the present invention having the above-described structure is as follows.

Referring back to FIG. 2, a new reel spool 16 is placed at the winding position (where the nip N is formed) by the gooseneck-type frame exchanger. The reel spool 16 is pushed toward the fixed reel drum 12 by the carriage (not shown). Here, the linear pressure at the nip P (the nip pressure) is maintained at a constant level by the carriage.

Figure 3:
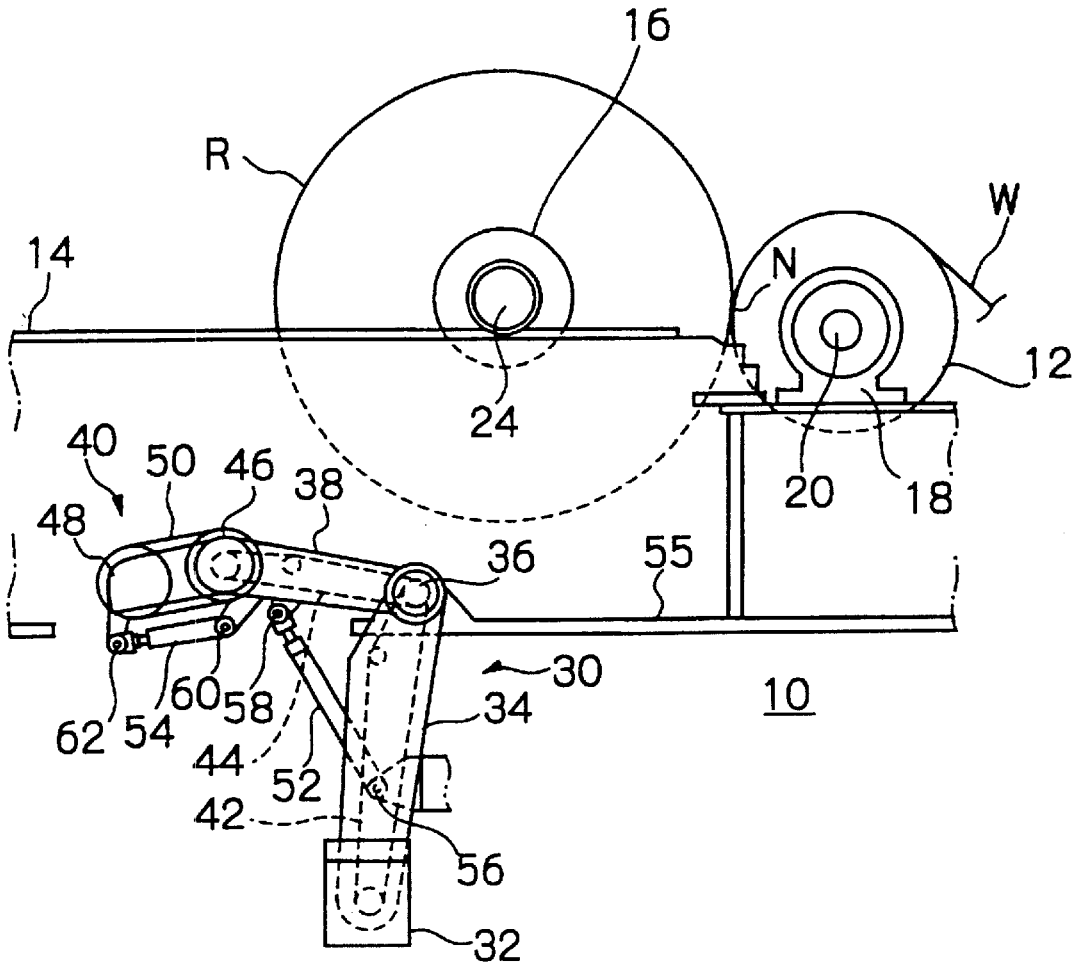
FIG. 3 is a view showing the winding roll presser device in a situation where the winding around the reel spool is almost completed in accordance with the present invention.

FIG. 3 is a view showing the winding roll presser device immediately before the winding around the reel spool 16 is completed. At this stage, the belt roll 40 that has been stationary is actuated by the timing belts 42 and 44, which are rotated by the motor 32. The moving speed of the belt roll 40 increased up to the speed equivalent to the rotational speed of the outer periphery of the winding roll R that is winding. Here, the rotational speed of the outer periphery is determined by the diameter of the winding roll R and the angular speed of the reel spool 16.

FIG. 1 is a view showing the situation where the belt roll 40 is in contact with the paper web W. In the transition from the situation shown in FIG. 3 to the situation shown in FIG. 1, the following operation is performed. When the moving speed of the belts 50 reaches the rotational speed of the outer periphery of the winding roll R, the first hydraulic cylinders 52 elongate to rotationally lift up the movable arm 38 clockwise around the rotation axis 36. The belts 50 are first brought into contact with the winding roll R at a location corresponding to the belt core 46 directly drive by the timing belt 44. Since the belts 50 are already rotating at the same speed as the paper web W, there is no friction caused between the paper W and the belts 50. After the contact, the entire belt roll 40 is slightly rotated clockwise around the belt core 46 by the second hydraulic cylinders 54, so that the belts 50 are brought into contact with the winding roll R at a location corresponding to the other belt core 48. Of the belts 50, the straight belt parts having a large area and a length equivalent to the distance between the belt core 46 and the belt core 48 are brought into contact with the winding roll R in the winding direction of the paper web W.

When the belt roll 40 is brought into contact with the winding roll R, a frame change is conducted. Although not shown in the figure, a gooseneck-type frame changer can be used here. With such a frame changer, the top end of the paper web W cut before the reel drum 12 is wound around a new reel spool 22. The last end of the paper web W that has been cut off is wound around the winding roll R.

In the situation shown in FIG. 1, the contact pressure from the belt roll 40 and the nip pressure from the nip N are put on the winding roll R. These pressures are controlled separately from each other by a unit such as the hydraulic cylinders 52 and 54 for moving the belt roll 40, and the carriage (not shown) for moving the reel spool 16, respectively. In the following, the method of controlling the contact pressure and the nip pressure will be explained.

The contact pressure is controlled by the first hydraulic cylinders 52 and the second hydraulic cylinders 54. Although not shown in the drawings, a unit for controlling the tension of the belts 50 can be provided for the belt roll 40. The contact pressure can be controlled by such a tension controller.

The contact pressure is zero at the time of the contact, and then increases to a predetermined level. Here, the contact pressure may increase stepwise over a period of time ranging from 30 seconds to 2 minutes, or may rapidly increase within 30 seconds. In the former method, as the contact pressure only gradually increases, the impact upon the paper web W is reduced, so is the amount of waste paper generated from the paper web W. The latter method should be employed for higher product quality. More specifically, if the belt roll 40 has too short a width to press the paper web W by the entire width and therefore leaves traces of the ends of the belts 50 on the paper web W, or if the joints of the belts 50 leave traces on the paper web W though the belt roll 40 can press the paper web W by the entire width, the latter method should be employed to solve each problem.

The nip pressure is normally maintained at a constant level by the carriage. However, the contact pressure affects the nip pressure, and therefore the carriage also compensates for it. More specifically, when the nip pressure increases due to the contact pressure, the carriage controls the nip pressure at a constant level. When the contact pressure reaches a predetermined level and stops increasing, the paper web W is cut for frame changing. The belt roll 40 continues to press the winding roll R to prevent the winding roll R from having slackness due to the cutting of the paper web W. The carriage reduces the nip pressure gradually. More specifically, the carriage pushes the reel spool 16 toward the belt roll 40, so as to gradually reduce the nip pressure. Meanwhile, the contact pressure is maintained at a constant level to prevent slackness of the paper. When the nip pressure reaches zero, the reel spool 16 separates from the reel drum 12 while rotating, and then moves toward the belt roll 40. Here, only the constant contact pressure is put on the paper web W.

After a sufficient space is secured by the movement of the winding roll R, the new reel spool 22, which has already started the winding after the frame change, is placed at the normal winding position and continues the winding.

Figure 4:
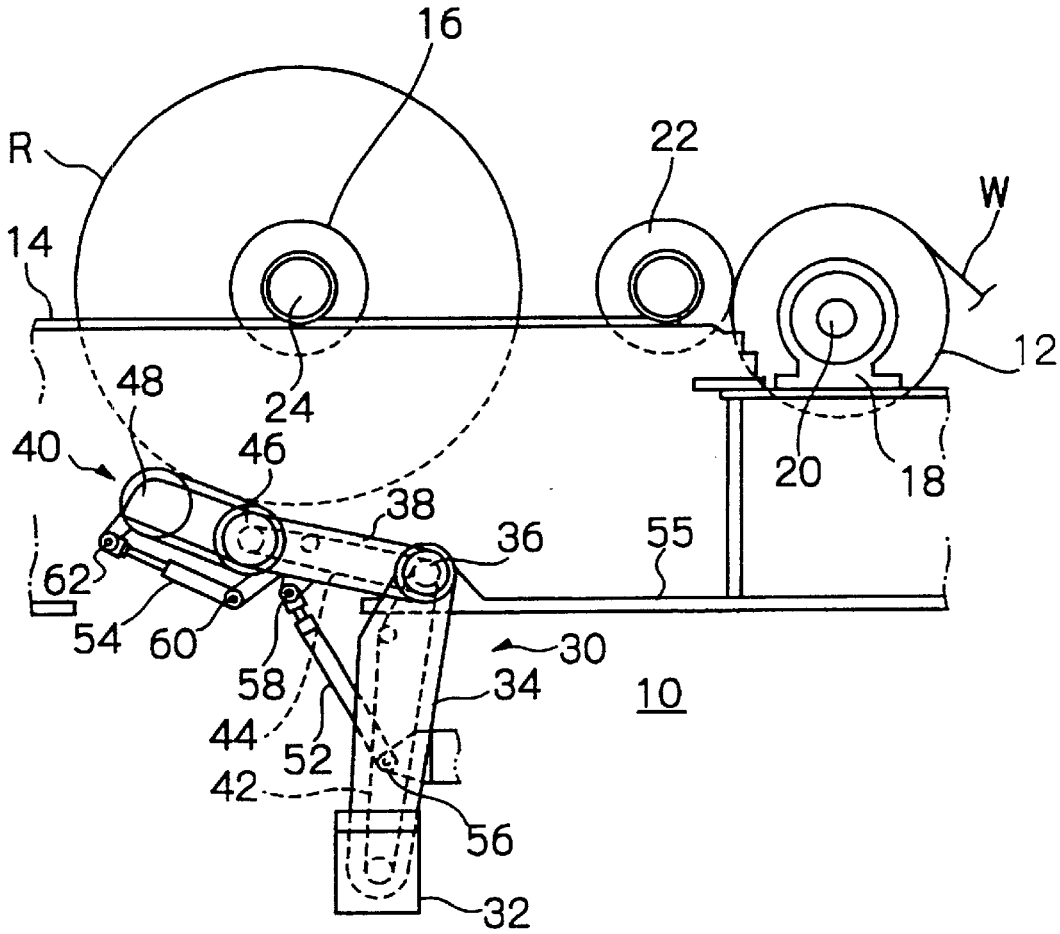
FIG. 4 is a view showing the winding roll presser device in a situation where the winding roll has been moved to a predetermined discharge position in accordance with the present invention.

FIG. 4 is a view showing the winding roll presser device in a situation where the winding roll R has been moved to a predetermined discharge position. In the discharge position, the winding roll R and the belt roll 40 gradually slow down while remaining in contact with each other, and finally stop rotating. The braking force for the rotation stop is supplied partly from the center drive device 100 and partly from the motor 32 driving the belt roll 40.

Since the wide belt parts have prevented slackness of the paper web W during the rotation, the winding roll R has no slackness. After the rotation stop of the winding roll R, the belt roll 40 returns to the initial position shown in FIG. 2, and the winding roll R is moved by the carriage on to the next process such as taping. During the move by the carriage, it is no longer necessary to press the cut end of the paper web W, because slackness is caused only during the rotation.

It should be noted that the present invention is not limited to the embodiments specifically disclosed above, but other variations and modifications may be made without departing from the scope of the present invention.

This patent application is based on Japanese priority patent application No. 2001-096196 filed on Mar. 29, 2001, the entire contents of which are hereby incorporated by reference.

What is claimed is:

1. A winding roll presser device that presses a winding roll by the entire width thereof, the winding roll being formed by a reel spool and a long material wound therearound, said device comprising:

a plurality of rotational rolls arranged in parallel with one another in the width direction;

a belt tensely wound so as to cover the plurality of rotational rolls;

a first drive unit for moving the belt from a stand-by position so as to bring the belt into contact with the winding roll; and a second drive unit having different rotational axes from the first drive unit for pressing the winding roll with a straight part of the belt.

2. The winding roll presser device as claimed in claim 1, wherein the belt is made of a reinforced rubber formed by adding a reinforced fiber to a rubber.

3. The winding roll presser device as claimed in claim 2, wherein the rubber is styrene-butadiene rubber.

4. The winding roll presser device as claimed in claim 1, wherein the first drive unit and the second drive unit comprise hydraulic cylinders.

5. The winding roll presser device as claimed in claim 1, further comprising a center drive unit for supplying turning force and braking force to the winding roll, the braking force being supplied partly from the center drive unit and partly from winding roll presser device.

6. A method of winding a long material around a winding roll via a nip, in which the long material is transported on a reel drum and the nip is formed by the winding roll contacting the reel drum, said method comprising the steps of:

a) rotating a winding roll presser device that presses the winding roll by the entire width thereof, at a speed equivalent to the rotational speed of the outer periphery of the winding roll;

b) bringing the winding roll presser device from a stand-by position into contact with an outer periphery of the winding roll by a predetermined length in the transporting direction of the long material, while still winding the long material around the winding roll;

c) increasing a linear pressure on the winding roll presser device to a predetermined level for a predetermined period during the winding of the long material;

d) cutting the long material before the reel drum;

e) separating the winding roll from the reel drum after a linear pressure on the nip is reduced to zero; and f) stopping the rotation of the winding roll and the winding roll presser device.

7. The method as claimed in claim 6, wherein the winding roll presser device includes a plurality of rotational rolls arranged in parallel with one another in the width direction, and a belt covering the plurality rotational rolls and wound around of the rolls.

8. The method as claimed in claim 6, wherein the linear pressure on the winding roll presser device is increased stepwise over a predetermined period of time to reduce loss of the long material.

9. The method as claimed in claim 6, wherein the linear pressure on the winding roll presser device is increased within a predetermined period of time to eliminate traces of the belt on the long material.

10. The method as claimed in claim 6, wherein the linear pressure on the winding roll presser device and the linear pressure on the nip are controlled independently of each other.

11. A method of winding a long material around a winding roll via a nip, in which the long material is transported on a reel drum and the nip is formed by the winding roll contacting the reel drum, said method comprising the steps of:

a) rotating a winding roll presser device that presses the winding roll by the entire width thereof, at a speed equivalent to a rotational speed of an outer periphery of the winding roll;

b) bringing a first portion of the winding roll presser device from a stand-by position into first contact with the outer periphery of the winding roll by means of a first driving unit of the winding roll presser device, and bringing a second portion of the winding roll presser device into second contact with the outer periphery of the winding roll by means of a second driving unit so as to allow the winding roll presser device to be in contact with the winding roll over a predetermined length in the transporting direction of the long material;

c) increasing a linear pressure of the winding roll presser device against the winding roll to a predetermined level;

d) cutting the long material before the reel drum;

e) separating the winding roll from the reel drum after a linear pressure on the nip is reduced; and f) stopping the rotation of the winding roll and the winding roll presser device.

* * * * *